US007178943B2

(12) United States Patent
Holten

(10) Patent No.: US 7,178,943 B2
(45) Date of Patent: Feb. 20, 2007

(54) LUMINAIRE WITH COUNTER-REFLECTOR AND REFRACTOR

(75) Inventor: Petrus Adrianus Josephus Holten, Winterswijk (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 80 days.

(21) Appl. No.: 10/497,432

(22) PCT Filed: Nov. 21, 2002

(86) PCT No.: PCT/IB02/04971

§ 371 (c)(1),
(2), (4) Date: Jun. 2, 2004

(87) PCT Pub. No.: WO03/048634

PCT Pub. Date: Jun. 12, 2003

(65) Prior Publication Data

US 2005/0024878 A1 Feb. 3, 2005

(30) Foreign Application Priority Data

Dec. 7, 2001 (EP) ..... 01204752

(51) Int. Cl.
*F21V 5/00* (2006.01)

(52) U.S. Cl. ..... 362/245; 362/296; 362/298; 362/301; 362/345

(58) Field of Classification Search ..... 362/245, 362/298, 301, 346, 243, 296, 643; 315/294
See application file for complete search history.

(56) References Cited

U.S. PATENT DOCUMENTS

| | | | | |
|---|---|---|---|---|
| 2,556,690 | A * | 6/1951 | Guth | 362/225 |
| 4,755,916 | A * | 7/1988 | Collins | 362/236 |
| 6,250,772 | B1 * | 6/2001 | Entrop et al. | 362/225 |
| 6,641,293 | B2 * | 11/2003 | Kumar et al. | 362/539 |
| 6,913,372 | B2 * | 7/2005 | Allcock et al. | 362/223 |

* cited by examiner

*Primary Examiner*—Renee Luebke
*Assistant Examiner*—Zahra I. Bennett

(57) ABSTRACT

A luminaire (1) comprising a concave reflector (2) enclosing a hollow space (3) and defining with an outer edge (4) a light emission window (5). The luminaire can accommodate at least two lamps (6, 7). The luminaire further comprises an optically semi-permeable wall (8) positioned in between the two lamps and dividing the hollow space into chambers (9, 10), and a counter-reflector (11) provided opposite the reflector. Light originating from the lamps can only leave the luminaire through the light emission window after passing through the semi-permeable wall. It is thus possible to obtain homogeneously mixed light as well as to obtain light of equal intensity from the various chambers, also when only one lamp is operating or the two lamps operate at different intensities.

15 Claims, 2 Drawing Sheets

LUMINAIRE WITH COUNTER-REFLECTOR AND REFRACTOR

Figure 1:
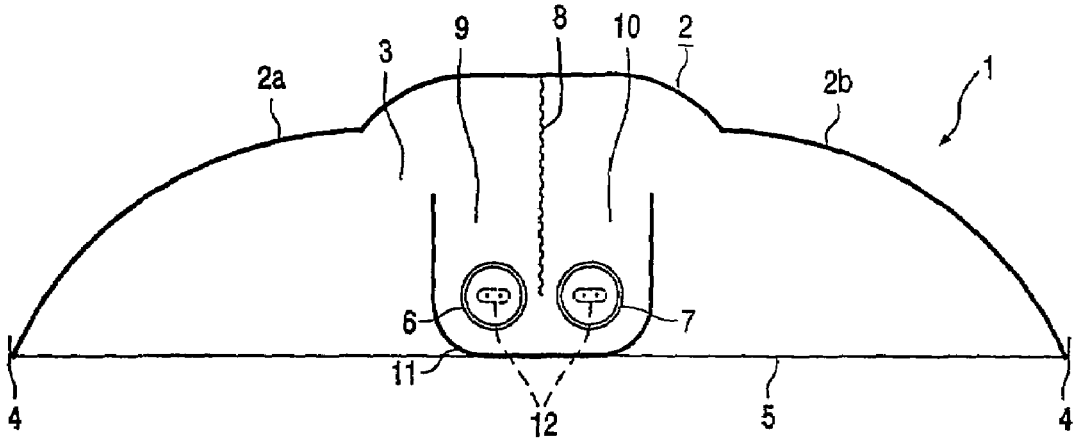

The invention relates to a luminaire comprising:

a concave reflector enclosing a hollow space and having an edge which defines a light emission window;

contact means for accommodating at least a first and a second electric lamp;

a separating wall which is light-transmitting and light-reflecting to equal degrees, which is perpendicular to the light emission window, which divides the hollow space into chambers, and which acts as a partitioning wall between the first and the second electric lamp to be accommodated.

Such a luminaire is known from DE-702556. The separating wall in the known luminaire is a flat, double-sided mirror in which light-transmitting provisions are made. Since the separating wall is positioned between the first and the second lamp, the hollow space in the known luminaire is divided by this wall into a first chamber for the first lamp and a second chamber for the second lamp. The separating wall is mirroring and light-transmitting in equal degrees, i.e. approximately half, i.e. 45 to 55% of the light reflected and transmitted by the separating wall, denoted incident light for short, is reflected, while the other half, i.e. 55 to 45% of this incident light passes through the separating wall. This renders it possible in the known luminaire for light from the first lamp to pass from the first chamber into the second chamber, and for light from the second lamp to pass from the second chamber into the first chamber. It is thus possible to provide a mixed light from the two chambers originating from light of the first lamp having a first color temperature, for example 2700°, together with light originating from the second lamp having a second color temperature, for example 6500°. The mixed light will have a color temperature which lies between this first and this second color temperature, for example 3300°. The known luminaire has the disadvantage that an insufficient mixing of light originating from the first and the second lamp is achieved, with the result that light of different color temperatures issues from the chambers. It is alternatively possible during operation of only one lamp of the luminaire, for example because the second lamp has failed, to obtain light both from the first and from the second chamber. Another disadvantage of the known luminaire is, however, that luminous fluxes of different magnitude issue from the chambers when only one lamp is operating.

It is an object of the invention to provide a luminaire of the kind described in the opening paragraph in which the above disadvantages are counteracted. This object is achieved in that a luminaire of the kind described in the opening paragraph is characterized in that the luminaire is provided with a counter-reflector, which counter-reflector is positioned opposite the concave reflector at a side of the contact means opposite to the concave reflector. Light issuing directly from the luminaire without the presence of a counter-reflector thus positioned results to a comparatively strong degree in the disadvantages of a comparatively high inhomogeneity of the mixed light and/or the unequal luminous fluxes from the chambers. The counter-reflector counteracts these disadvantages in that light directly issuing from the lamp is reflected back into the hollow space of the luminaire owing to the reflection against the counter-reflector. At least a portion of the light reflected back by the counter-reflector is directly incident on the separating wall. The light reflected back may possibly be incident on the separating wall via a subsequent reflection against the reflector. The separating wall will thus reflect approximately half of each light beam incident on the separating wall and will transmit approximately half thereof, thus equally dividing the light over the chambers. A better homogeneity is achieved thereby of the mixed light when lamps of different color temperatures are used. At the same time, luminous intensities which are more equal are achieved for light issuing from the different chambers, for example when lamps of different luminous intensities are operated in the chambers, or when only one lamp is operated. The separating wall may be provided with transparent portions so as to be partly light-transmitting, or alternatively the separating wall may be provided with openings. Preferably, these openings are arranged as small elongate slots in a direction perpendicular to the light emission window, which slots have a width which is smallest at the area of the lamp, said width increasing in directions away from the lamp and perpendicular to the light emission window. In other words, the slots have a substantially diabolo shape viewed in a direction perpendicular to the separating wall. It was found that comparatively good results are obtained with such openings as regards the generation of light of equal intensity from the chambers and the equal distribution or mixing of light over the chambers.

In a favorable embodiment, the luminaire is characterized in that each straight line between the edge of the reflector and the lamp is intersected by the counter-reflector. The lamps are screened from direct visibility from outside the luminaire by this measure in that light cannot issue from the luminaire directly, i.e. without reflection, but only after being reflected either by the reflector or by the counter-reflector and the reflector. It is achieved thereby that the light has a greater chance of hitting the separating wall, so that a still better homogeneity of mixed light and of luminous fluxes from the chambers is achieved. The measure that each straight line between the edge of the reflector and the lamp is intersected by the counter-reflector results in a cut-off angle $\alpha$ for the reflector and a cut-off angle $\beta$ for the counter-reflector with respect to each of the relevant lamps in the respective chambers. The cut-off angle $\alpha$ of the reflector here partly overlaps the cut-off angle $\beta$ of the counter-reflector for each lamp. This counteracts that light originating from the lamp can issue directly from the luminaire to the exterior without hitting the separating wall. It is alternatively known that even reflectors of comparatively good quality lead to a loss of light, though comparatively small, upon each reflection. To keep light losses within bounds and at the same time to prevent light from issuing directly from the luminaire, it is favorable to limit the overlap of the cut-off angles $\alpha$ and $\beta$ to a small value of 0.1 to 5°. A limitation to such small values has the advantage that the light has a comparatively high probability of leaving the luminaire after only a single reflection, and that unnecessary light losses owing to multiple light reflections are counteracted.

In a further favorable embodiment, the luminaire is characterized in that at least the counter-reflector is specularly reflecting. The specular reflection of the counter-reflector renders it possible that, given a suitable mutual positioning and shaping of the counter-reflector, the lamp, and the separating wall, all the light from the lamp directly incident on the counter-reflector will subsequently be incident on the separating wall. In other words, the reflected image of the lamp is imaged on the separating wall by the counter-reflector. It is achieved thereby that a greater portion of the light issued by the lamp is incident on the separating wall, whereby an even better homogeneity of mixed light and of luminous fluxes from the chambers is achieved.

In a particularly favorable embodiment, the luminaire is characterized in that light incident on the reflector or the counter-reflector and directly originating from the lamp is reflected on the separating wall. It is achieved by this measure that not only the light directly incident on the separating wall, but all the reflected light will reach the separating wall. The light generated by the lamps will only be capable of issuing from the luminaire through the light emission window to the exterior after being incident on the separating wall at least once, whereby it has been distributed equally over the two chambers.

In an alternative embodiment, the luminaire is characterized in that the reflector is extended by a respective sub-reflector for each chamber. The dimensions and shape of the relevant sub-reflector may be adapted to the lamp in question. It is thus possible, for example, to obtain a higher luminous flux from the luminaire, or to choose the dimensions of the luminaire to be as favorable as possible, for example as small as possible. An example of such a luminaire, in which each chamber has an associated sub-reflector, is a luminaire for low-pressure mercury vapor gas discharge lamps, which luminaire is characterized in that the reflectors are positioned on either side of the separating wall, are elongate, and are concave towards one another. Low-pressure mercury vapor gas discharge lamps are particularly suitable for being manufactured with different color temperatures, for example with respective color temperatures of 2700° C. and 6500° C. The use of lamps having such different color temperatures in the luminaire according to the invention renders it possible to obtain a homogeneous mixed light from each individual chamber with a color temperature lying in a range from 2700 to 6500° C., for example 5000° C., and of equal luminous intensities.

Figure 3:
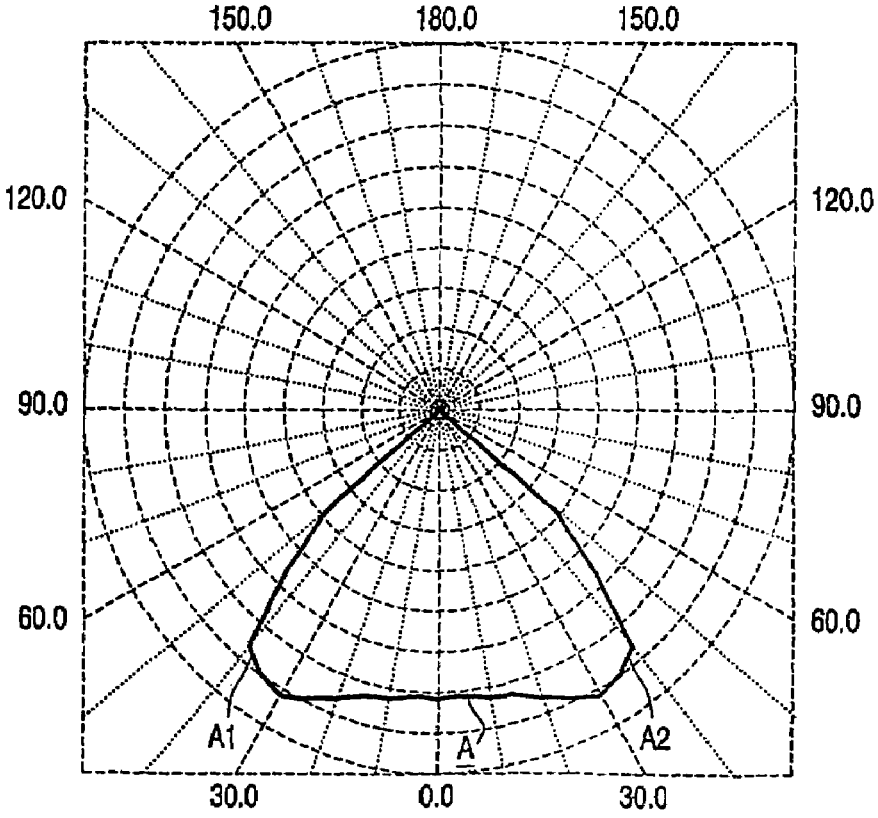
Figure 2:
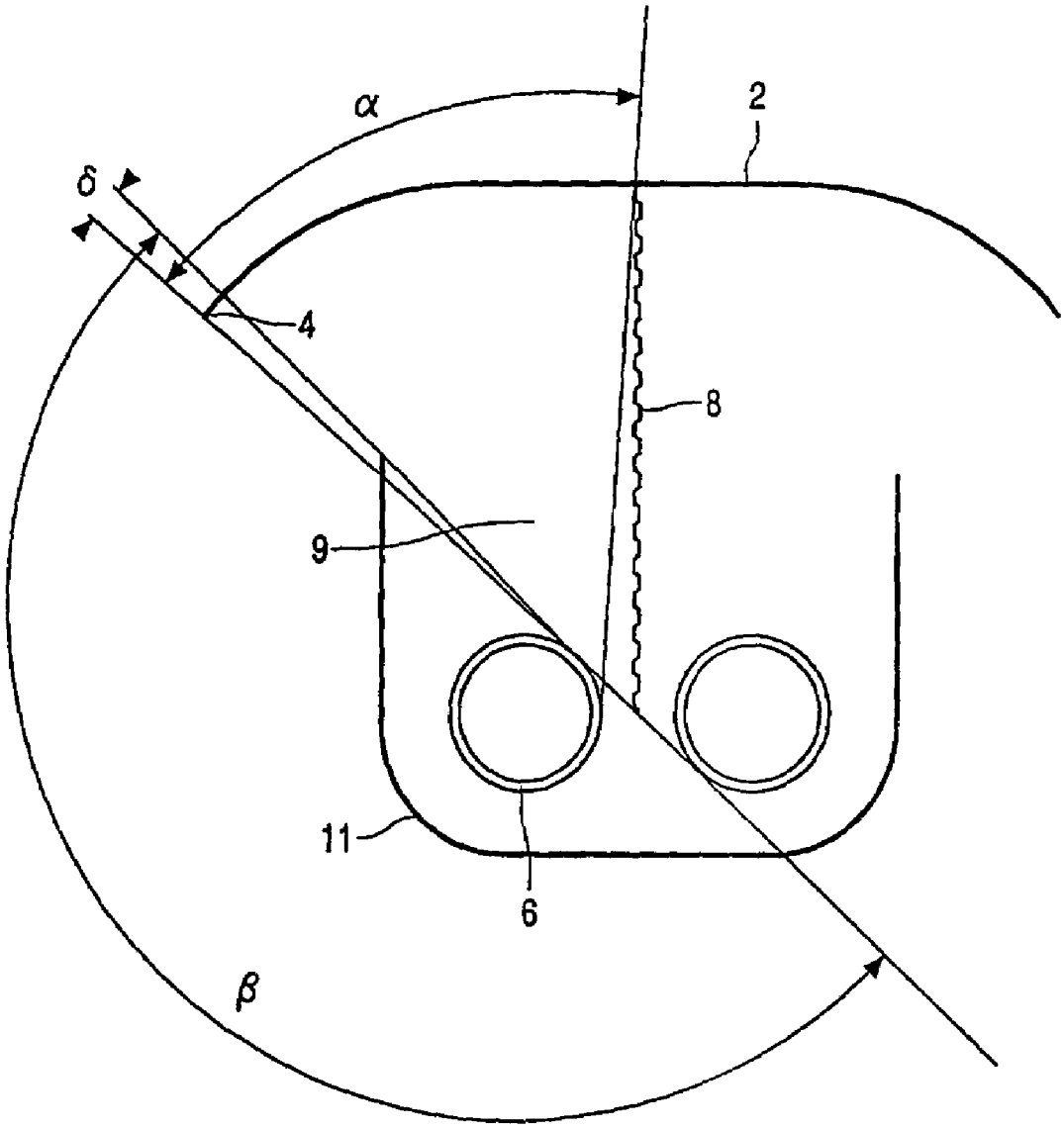

An embodiment of the luminaire according to the invention is diagrammatically shown in the drawing, in which FIG. 1 is a cross-sectional view of a first embodiment of a luminaire according to the invention;

FIG. 2 is a cross-sectional view of a second embodiment of a luminaire according to the invention; and FIG. 3 is a luminous intensity diagram relating to the luminaire of FIG. 1 during operation of only a single lamp.

FIG. 1 shows a luminaire 1 comprising a concave reflector 2 which encloses a hollow space 3 having an edge 4 limiting a light emission window 5. The luminaire is provided with contact means 12, shown in broken lines, in which a first 6 and a second electric lamp 7, low-pressure mercury vapor discharge lamps with respective color temperatures of 2700° and 6500° in FIG. 1, are held. The luminaire 1 comprises furthermore a separating wall 8 which is light-transmitting and light-reflecting to equal degrees and which is perpendicular to the light emission window. The separating wall 8 is a planar mirror provided with slotted openings of substantially diabolo shape which are evenly distributed over the surface of the mirror, so that the mirror is light-transmitting for 50% and reflecting for 50%. The separating wall 8 divides the hollow space 3 into a first 9 and a second chamber 10 and acts as a partitioning wall between the first and the second electric lamp.

The luminaire is further provided with a counter-reflector 11, which counter-reflector is positioned in the hollow space 3 opposite the concave reflector 2 at a side of the contact means 12 substantially opposed to the concave reflector. Sub-reflectors 2*a*, 2*b*, which are elongate and which define a longitudinal direction of the luminaire, extend the concave reflector 2 in a transverse direction for the respective chambers. Hence, when viewed along lines transversal to the light emission window 5 and along the separating wall 8, the contact means 12 are positioned in between the concave reflector 2 and the counter reflector 11. The sub-reflectors 2*a*, 2*b* are concave towards one another and are positioned on either side of the separating wall 8, giving the light a comparatively small exit angle at which the light leaves the luminaire.

In FIG. 2 showing a second embodiment of the luminaire according to the invention, each straight line between the edge 4 of the reflector 2 and the lamp 6 is intersected by the counter-reflector 11. This measure results in a cut-off angle $\alpha$ of the reflector 2 and a cut-off angle $\beta$ of the counter-reflector 11 for the first chamber 9 in which the lamp 6 is accommodated. FIG. 2 shows that the angles $\alpha$ and $\beta$ have an overlap $\delta$ of only a few degrees.

FIG. 3 is a luminous intensity diagram obtained from the luminaire of FIG. 1 with only one lamp operating. The curve A shows the distribution in a plane perpendicular to the longitudinal direction of the luminaire, A1 and A2 representing the distribution of the luminous intensity obtained from the first and the second chamber, respectively. It is apparent from FIG. 3 that light of the same intensity and distribution is obtained from the two chambers.

The invention claimed is:

1. A luminaire (1) comprising:

a concave reflector (2) enclosing a hollow space (3) and having an edge (4) which defines a light emission window (5);

contact means (12) for accommodating at least a first (6) and a second electric lamp (7);

a separating wall (8) which is both light-transmitting and light-reflecting in substantially equal proportion, which is perpendicular to the light emission window (5), which divides the hollow space into chambers (9, 10), and which acts as a partitioning wall between the first (6) and the second (7) electric lamp to be accommodated, wherein the luminaire is provided with a counter-reflector (11) , which counter-reflector (11) is positioned inside the light emission window (5) opposite the concave reflector (2) at a side of the contact means opposite to the concave reflector (2) and further wherein the separating wall (8) is fixedly attached to the concave reflector (2) and extends in a direction perpendicular to and towards said light emission window (5), and wherein light originating from said at least first (6) and second electric lamps (7) can only leave said luminaire (1) through the light emission window after being reflected either by the concave reflector (2) or by the counter-reflector (11) and the concave reflector (2), and wherein at least a portion of the light reflected back by the counter-reflector is directly incident on the separating wall, thereby achieving a better homogeneity of the mixed light and of the luminous fluxes from the chambers (9,10).

2. A luminaire as claimed in claim 1, wherein each straight line between the edge (4) of the reflector (2) and the lamp (6, 7) is intersected by the counter-reflector (11).

3. A luminaire as claimed in claim 1, wherein at least the counter-reflector (11) is specularly reflecting.

4. A luminaire as claimed in claim 1, wherein light incident on the reflector (2) or the counter-reflector (11) and directly originating from the lamp (6, 7) is reflected on the separating wall (8).

5. A luminaire as claimed in claim 1, wherein the reflector (2) is extended by a respective sub-reflector (2*a*, 2*b*) for each chamber (9, 10).

6. A luminaire as claimed in claim 1, wherein the separating wall (8) is provided with elongate slotted openings with a longitudinal direction perpendicular to the light emission window (5), which slotted openings have a width which is smallest at the area of the lamp (6, 7), said width increasing in directions away from the lamp and perpendicular to the light emission window.

7. A luminaire as claimed in claim 1, wherein the separating wall (8) includes openings arranged as small slots elongate in a direction perpendicular to the light emission window.

8. A luminaire as claimed in claim 5, wherein the sub-reflectors (2*a*, 2*b*) are positioned on either side of the separating wall (8), are elongate, and are concave towards one another.

9. A luminaire as claimed in claim 7, wherein the slots have a width which is narrowest at the area of the lamp and wherein said with increases in directions away from the lamp and perpendicular to the light emission window.

10. A luminaire (1) comprising:

a concave reflector (2) enclosing a hollow space (3) and having an edge (4) which defines a light emission window (5);

contact means (12) for accommodating at least a first (6) and a second electric lamp (7);

a separating wall (8) which is light-transmitting and light-reflecting to equal degrees, which is perpendicular to the light emission window, which divides the hollow space into chambers (9, 10), and which acts as a partitioning wall between the first and the second electric lamp to be accommodated, wherein the luminaire is provided with a counter-reflector (11), which counter-reflector is positioned opposite the concave reflector at a side of the contact means opposite to the concave reflector, wherein the separating wall (8) is provided with elongate slotted openings with a longitudinal direction perpendicular to the light emission window (5), which slotted openings have a width which is smallest at the area of the lamp (6, 7), said width increasing in directions away from the lamp and perpendicular to the light emission window.

11. A luminaire as claimed in claim 10, wherein each straight line between the edge (4) of the reflector (2) and the lamp (6, 7) is intersected by the counter-reflector (11).

12. A luminaire as claimed in claim 10, wherein at least the counter-reflector (11) is specularly reflecting.

13. A luminaire as claimed in claim 10, wherein light incident on the reflector (2) or the counter-reflector (11) and directly originating from the lamp (6, 7) is reflected on the separating wall (8).

14. A luminaire as claimed in claim 10, wherein the reflector (2) is extended by a respective sub-reflector (2*a*, 2*b*) for each chamber (9, 10).

15. A luminaire as claimed in claim 14, wherein the sub-reflectors (2*a*, 2*b*) are positioned on either side of the separating wall (8), are elongate, and are concave towards one another.

* * * * *